US012569956B2

(12) United States Patent
Miki et al.

(10) Patent No.: US 12,569,956 B2
(45) Date of Patent: Mar. 10, 2026

(54) CONTROL METHOD FOR PROCESSING OF A SUBSTRATE

(71) Applicant: Kioxia Corporation, Tokyo (JP)

(72) Inventors: Tsutomu Miki, Yokkaichi Mie (JP); Yuta Suzuki, Tokyo (JP); Taro Takahashi, Tokyo (JP); Katsuhide Watanabe, Tokyo (JP)

(73) Assignee: Kioxia Corporation, Tokyo (JP)

( * ) Notice: Subject to any disclaimer, the term of this patent is extended or adjusted under 35 U.S.C. 154(b) by 299 days.

(21) Appl. No.: 17/672,857

(22) Filed: Feb. 16, 2022

(65) Prior Publication Data

US 2022/0266414 A1 Aug. 25, 2022

(30) Foreign Application Priority Data

Feb. 22, 2021 (JP) ..... 2021-026105

(51) Int. Cl.
*B24B 37/013* (2012.01)
*B24B 37/04* (2012.01)
*B24B 49/00* (2012.01)

(52) U.S. Cl.
CPC ..... *B24B 37/013* (2013.01); *B24B 37/042* (2013.01); *B24B 49/003* (2013.01)

(58) Field of Classification Search
None
See application file for complete search history.

(56) References Cited

U.S. PATENT DOCUMENTS 10,478,937 B2 11/2019 Tang et al.
10,688,620 B2 6/2020 Shinozaki et al.
2002/0013124 A1* 1/2002 Tsujimura ..... B24B 49/12 451/138
2003/0055526 A1* 3/2003 Avanzino ..... B24B 37/015 216/84
2003/0087586 A1 5/2003 Kaushal et al.
2006/0100821 A1 5/2006 Das et al.
(Continued)

FOREIGN PATENT DOCUMENTS

CN 105415191 A 3/2016
CN 107427987 A 12/2017
(Continued)

OTHER PUBLICATIONS

Office Action issued in corresponding U.S. Appl. No. 17/674,705, dated Sep. 21, 2023 (19 pages).
(Continued)

*Primary Examiner* — Brian D Keller
*Assistant Examiner* — Jason Khalil Hawkins
(74) *Attorney, Agent, or Firm* — Foley & Lardner LLP

(57) ABSTRACT

A method of accurately detecting an end point of substrate polishing using an acoustic sensor is disclosed.

The method includes: detecting an acoustic event occurring with polishing of a substrate and outputting the acoustic event as acoustic signals; generating power spectra from the acoustic signals, each of the power spectra indicating a spectrum of a sound-pressure level; generating a power spectrum map indicating a temporal change in power spectrum by arranging the power spectra in a time-series order; and detecting a polishing end point of the substrate based on a change in the sound-pressure level in the power spectrum map.

10 Claims, 16 Drawing Sheets

(56) References Cited

U.S. PATENT DOCUMENTS

| | | | | |
|---|---|---|---|---|
| 2011/0318992 | A1* | 12/2011 | David | B24B 37/013 451/6 |
| 2013/0052916 | A1* | 2/2013 | David | B24B 37/013 451/6 |
| 2014/0329439 | A1 | 11/2014 | Chew et al. | |
| 2016/0256978 | A1* | 9/2016 | Tang | B24B 37/013 |
| 2017/0263512 | A1* | 9/2017 | Ono | H01L 21/67092 |
| 2019/0047117 | A1 | 2/2019 | Watanabe et al. | |
| 2019/0076985 | A1 | 3/2019 | Ono et al. | |
| 2019/0283204 | A1 | 9/2019 | Swedek et al. | |
| 2019/0286111 | A1 | 9/2019 | Yennie et al. | |
| 2019/0299356 | A1 | 10/2019 | Xu et al. | |
| 2020/0101579 | A1 | 4/2020 | Suzuki | |

FOREIGN PATENT DOCUMENTS

| | | | |
|---|---|---|---|
| CN | 107877356 | A | 4/2018 |
| CN | 109382755 | A | 2/2019 |
| CN | 109773648 | A | 5/2019 |
| EP | 0 616 362 | A2 | 9/1994 |
| JP | 2001-015467 | A | 1/2001 |
| JP | 2008-503356 | A | 2/2008 |
| JP | 2015-008303 | A | 1/2015 |
| JP | 2017-163100 | A | 9/2017 |
| JP | 2018-508123 | A | 3/2018 |
| JP | 2019-048344 | A | 3/2019 |
| JP | 2020-053550 | A | 4/2020 |
| KR | 10-2017-0125382 | A | 11/2017 |
| KR | 10-2018-0036545 | A | 4/2018 |
| TW | 536454 | B | 6/2003 |
| TW | I641038 | B | 11/2018 |
| TW | 201945119 | A | 12/2019 |
| TW | 202015858 | A | 5/2020 |
| WO | WO-2016/140769 | A1 | 9/2016 |
| WO | WO-2021/029264 | A1 | 2/2021 |

OTHER PUBLICATIONS

US Non-Final Office Action for U.S. Appl. No. 17/674,705 dated Sep. 5, 2024 (38 pages).
KR Office Action for KR Appl. Ser. No. 10-2022-0018067 dated Aug. 5, 2025 (12 pages).
Taiwanese Search Report for TW Appl. Ser. No. 111106053 dated Oct. 15, 2025 (2 pages).

* cited by examiner

CONTROL METHOD FOR PROCESSING OF A SUBSTRATE

CROSS REFERENCE TO RELATED APPLICATION

This document claims priority to Japanese Patent Application Number 2021-026105 filed Feb. 22, 2021, the entire contents of which are hereby incorporated by reference.

BACKGROUND

In a manufacturing process of a semiconductor device, a polishing apparatus for polishing a surface of a substrate, such as a semiconductor substrate, is widely used. In this type of polishing apparatus, the substrate is rotated while being held by a substrate holder called a top ring or a polishing head. In this state, while a polishing table is rotated together with a polishing pad, the surface of the substrate is pressed against a polishing surface of the polishing pad. The surface of the substrate is rubbed against the polishing surface in the presence of a polishing liquid, so that the surface of the substrate is polished. When a film thickness of the substrate surface reaches a predetermined value or when it is detected that an underlying layer (e.g., a stopper layer) appears as a result of polishing of the substrate surface, the substrate polishing process is terminated.

In such a polishing process, it is required to accurately control the film thickness of the substrate surface after being processed, and therefore it is important to accurately detect an end of polishing of the substrate. Various methods have been studied for detecting the end of polishing of the substrate. For example, a technique of detecting a change in polishing sound using an acoustic sensor is proposed.

For example, Japanese laid-open patent publication No. 2017-163100 discloses a controller configured to detect a power spectrum of a polishing sound emitted from a substrate, and calculate an S/N ratio per unit time from an amount of change in the power spectrum to determine an end point of polishing of substrate at which the obtained S/N ratio exceeds a threshold value.

Polishing conditions (e.g., a condition of the polishing pad, a distribution of the polishing liquid, a pressing force applied from the polishing pad) in the polishing of the substrate are not always constant, and there may be a variation in the amount of change in the power spectrum obtained from measurement by the acoustic sensor. As a result, the timing at which the value of the S/N ratio exceeds the threshold value (the timing of the end of polishing) may vary. Moreover, if the S/N ratio does not exceed the threshold value, the end of polishing cannot be detected.

SUMMARY

In view of the foregoing issues, embodiments, which will be discussed below, provide a control method for processing of a substrate capable of accurately detecting an end point of polishing of a substrate using an acoustic sensor.

The embodiments, which will be described below, relate to a control method for processing of a surface of a substrate, such as a semiconductor substrate.

In an embodiment, there is provided a control method for processing of a substrate by a substrate processing apparatus configured to polish the substrate by pressing the substrate against a polishing pad, comprising: detecting an acoustic event occurring with polishing of the substrate and outputting the acoustic event as acoustic signals; generating power spectra from the acoustic signals, each of the power spectra indicating a spectrum of a sound-pressure level; generating a power spectrum map indicating a temporal change in power spectrum by arranging the power spectra in a time-series order; and detecting a polishing end point of the substrate based on a change in the sound-pressure level in the power spectrum map.

In an embodiment, detecting the polishing end point of the substrate comprises detecting the polishing end point of the substrate by detecting a change in the sound-pressure level only in a predetermined monitoring frequency band in the power spectrum map. As a result, the processing required for detecting the polishing end of the substrate can be reduced.

In an embodiment, the monitoring frequency band is set according to a material constituting each layer of the substrate. As a result, the monitoring frequency band can be set appropriately according to the material constituting the substrate.

In an embodiment, generating the power spectra comprises generating the power spectra using only the acoustic signals in a latest predetermined time. As a result, the processing of generating the power spectra can be reduced.

In an embodiment, detecting the polishing end point of the substrate comprises inputting an image of the power spectrum map into a trained model that generates a polishing end index indicating a degree of polishing end, and detecting the polishing end point of the substrate at which the polishing end index exceeds a predetermined value. As a result, the end point of the substrate polishing can be accurately detected.

In an embodiment, the substrate processing apparatus includes a polishing head forming pressure chambers configured to press the substrate, and a pressure controller configured to perform pressure feedback control to individually control pressures in the pressure chambers. Detecting the polishing end point of the substrate further comprises: detecting times when changes in power spectrum maps occur, the power spectrum maps being generated by acoustic sensors provided in the polishing pad; and determining an area where a surface of the substrate is exposed based on a difference between the times. The pressure controller reduces pressure in pressure chamber corresponding to the area where the surface of the substrate is exposed. As a result, a variation in amount of polishing of the surface of the substrate can be suppressed.

According to the above-described embodiments, the power spectra each indicating the spectrum of the sound-pressure level of the substrate-polishing sound is generated, and the polishing end point of the substrate is detected based on the change in the sound-pressure level in the power spectrum map indicating a temporal change in power spectrum. Therefore, the end point of the substrate polishing can be accurately detected using the acoustic sensor.

DESCRIPTION OF EMBODIMENTS

Figure 1:
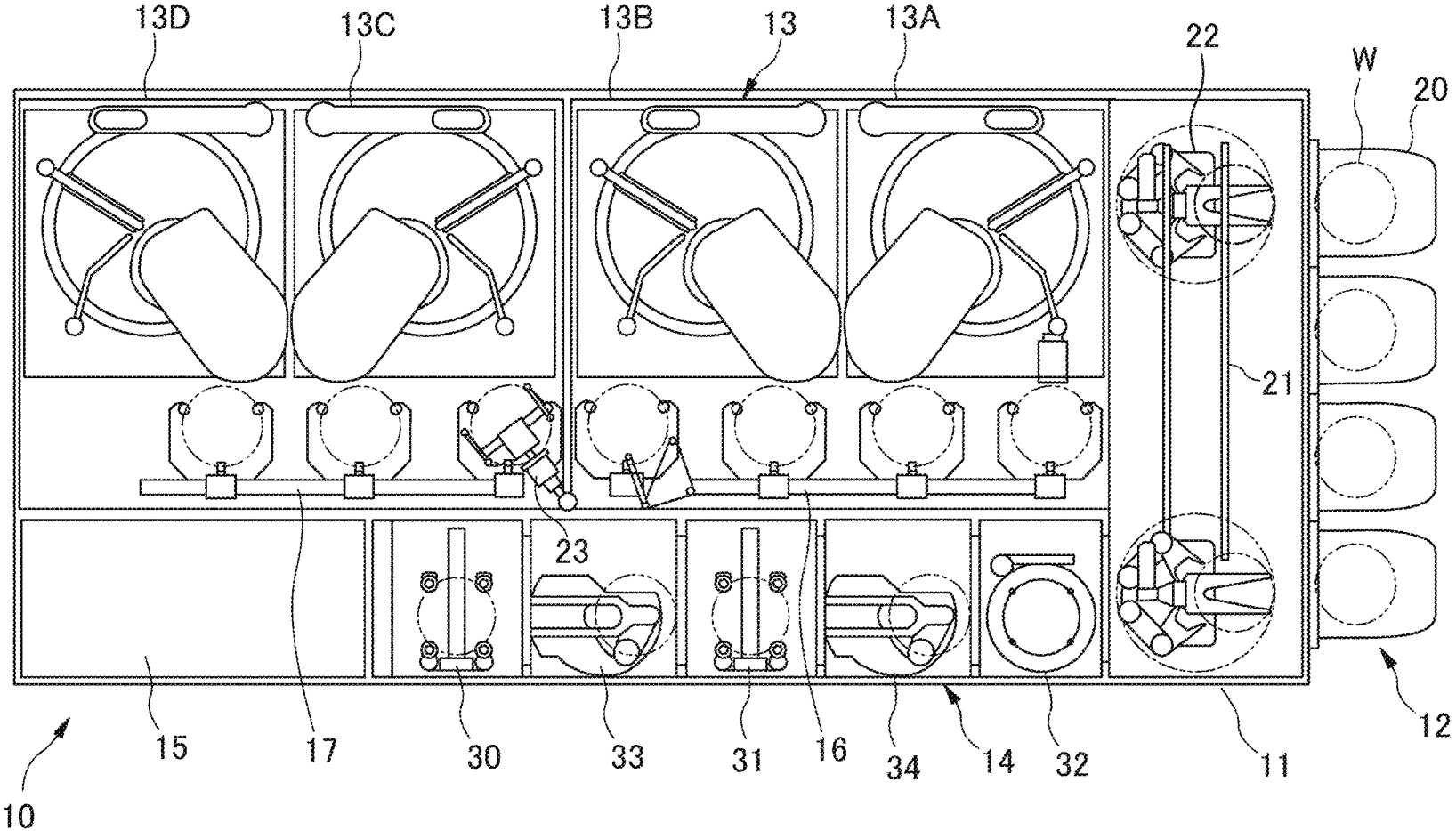
FIG. 1 is a plan view schematically showing a structure of a substrate processing apparatus according to an embodiment.

Hereinafter, a control method for processing of a substrate according to an embodiment will be described with reference to the drawings. Identical or corresponding elements are denoted by the same reference numerals, and their repetitive explanations will be omitted.

FIG. 1 is a plan view showing an entire structure of a substrate processing apparatus. A substrate processing apparatus 10 is partitioned into a loading-unloading section 12, a polishing section 13, and a cleaning section 14, which are provided inside a housing 11 having a rectangular shape. The substrate processing apparatus 10 further includes a controlling device 15 configured to control operations of processing, such as substrate transfer, polishing, and cleaning.

The loading-unloading section 12 includes a plurality of front loaders 20, a moving mechanism 21, and two transfer robots 22. Substrate cassettes, each storing a large number of substrates (wafers) W therein, are placed on the front loaders 20. Each transfer robot 22 includes two hands disposed one above the other. The transfer robot 22 moves on the moving mechanism 21 to remove a substrate W from the substrate cassette on the front loader 20 and transport the substrate W to the polishing section 13. The transfer robot 22 is further operable to return a processed substrate, which has been transported from the cleaning section 14, into the substrate cassette.

The polishing section 13 is an area for polishing (planarizing) the substrate. A plurality of polishing units 13A to 13D are provided and arranged along a longitudinal direction of the substrate processing apparatus. Each polishing unit includes a top ring configured to polish the substrate W while pressing the substrate W against a polishing pad on a polishing table, a liquid-supply nozzle configured to supply a liquid, such as a polishing liquid or pure water, onto the polishing pad, a dresser for dressing a polishing surface of the polishing pad, and an atomizer configured to emit a fluid mixture of liquid and gas or an atomized liquid onto the polishing surface to wash away polishing debris and abrasive grains remaining on the polishing surface.

A first linear transporter 16 and a second linear transporter 17, which are transporting mechanisms each configured to transport the substrate W, are provided between the polishing section 13 and the cleaning section 14. The first linear transporter 16 is configured to be able to move between a first position for receiving the substrate W from the loading-unloading section 12, a second position for transporting and receiving the substrate W to and from the polishing unit 13A, a third position for transporting and receiving the substrate W to and from the polishing unit 13B, and a fourth position for transporting and receiving the substrate W to and from the second linear transporter 17.

The second linear transporter 17 is configured to be able to move between a fifth position for receiving the substrate W from the first linear transporter 16, a sixth position for transporting and receiving the substrate W to and from the polishing unit 13C, and a seventh position for transporting and receiving the substrate W to and from the polishing unit 13D. A swing transporter 23 is provided between these transporters 16 and 17. The swing transporter 23 is configured to transport the substrate W from the fourth position or the fifth position to the cleaning section 14 and from the fourth position to the fifth position.

The cleaning section 14 includes a first substrate cleaning device 30, a second substrate cleaning device 31, a substrate drying device 32, and transfer robots 33 and 34 configured to transport and receive the substrate W between these devices. The substrate W, which has been polished by the polishing unit, is cleaned (primary cleaning) by the first substrate cleaning device 30, and then further cleaned (finish cleaning) by the second substrate cleaning device 31. The cleaned substrate is transported from the second substrate cleaning device 31 to the substrate drying device 32, where the cleaned substrate is spin-dried. The dried substrate W is returned to the loading-unloading section 12.

Figure 2:
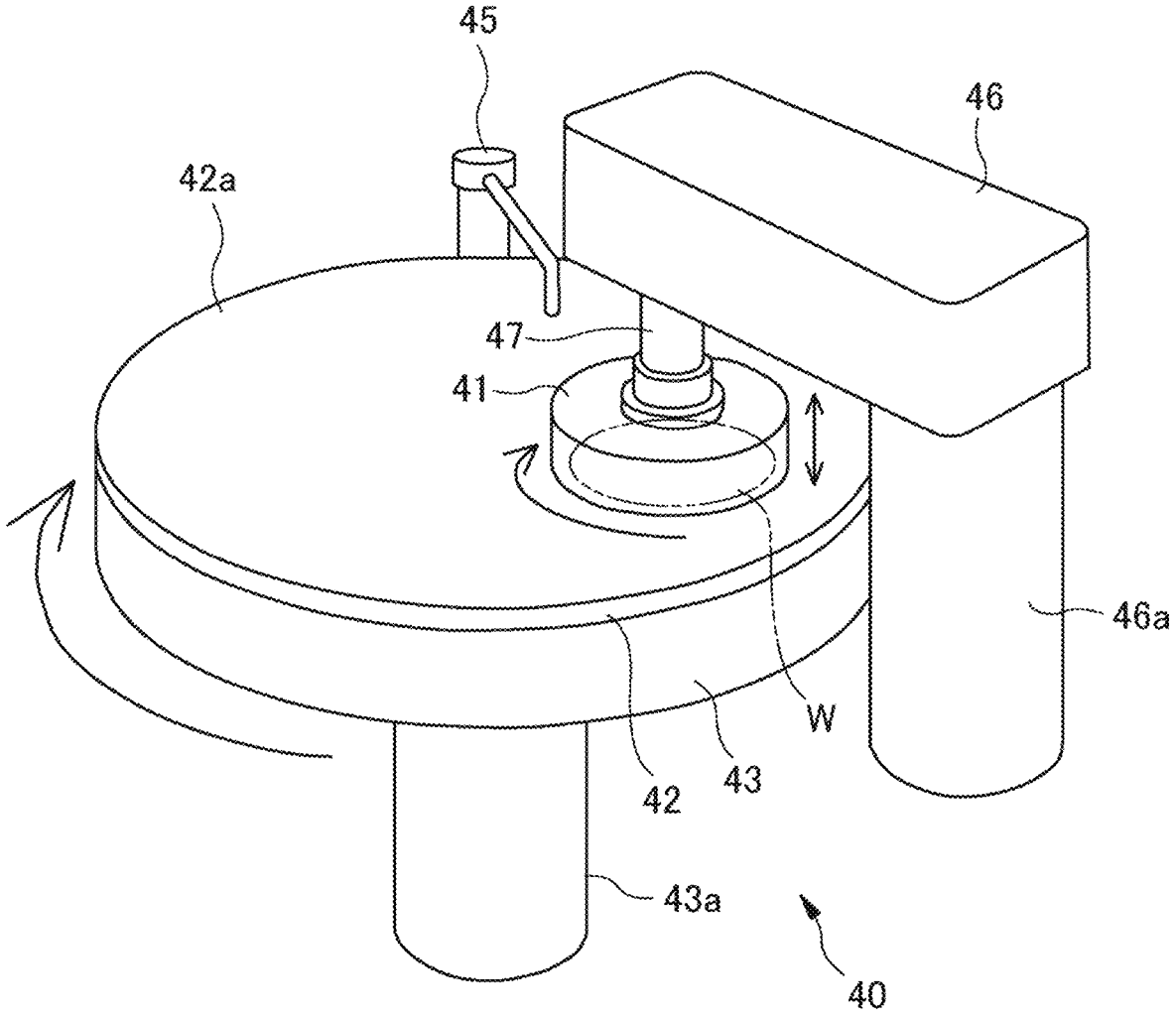
FIG. 2 is a perspective view schematically showing an embodiment of a substrate polishing unit.
Figure 3:
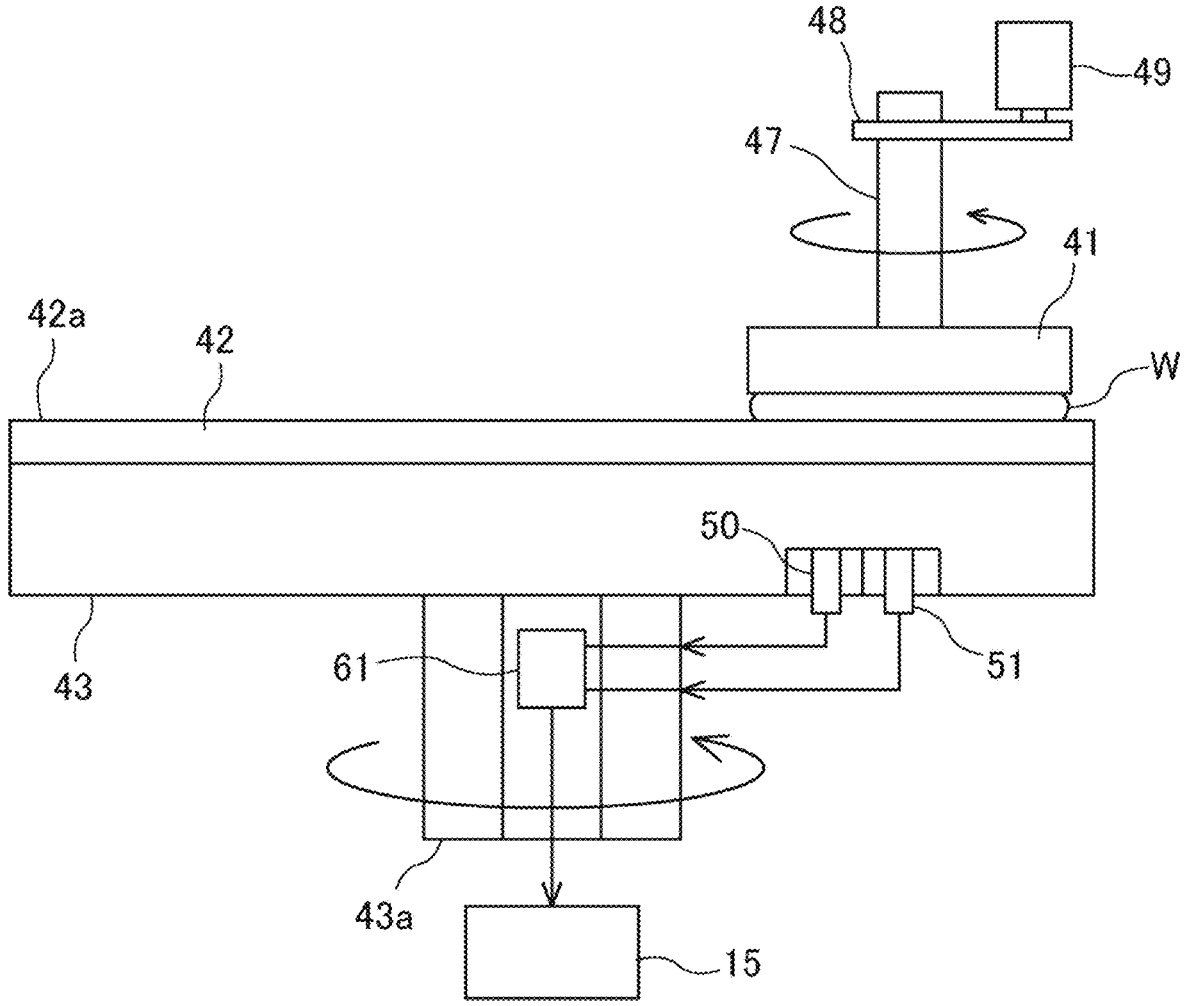
FIG. 3 is a side view showing a structure of the substrate polishing unit.

FIG. 2 is a perspective view schematically showing a structure of the polishing unit. A polishing unit 40 includes a top ring (or a substrate holder) 41 configured to hold and rotate the substrate (wafer) W, a polishing table 43 configured to support a polishing pad 42, and a polishing-liquid-supply nozzle 45 configured to supply a slurry (polishing liquid) onto the polishing pad 42. Acoustic sensors 50 and 51 shown in FIG. 3 are provided below the polishing pad 42.

The top ring 41 is rotatably supported by a top-ring shaft 47 and a top-ring head cover 46, and is configured to be able to hold the substrate W on its lower surface by vacuum suction. The top-ring head cover 46 is rotatably supported by a rotating shaft 46*a*. A rotation of the rotating shaft 46*a* causes the top ring 41 to move between a polishing position for polishing the substrate W and an exchange position for exchanging the substrate W.

The polishing table 43 can be rotated around a table shaft 43*a* by a motor (not shown). The top ring 41 and the polishing table 43 rotate in directions indicated by arrows, while the top ring 41 presses the substrate W against a polishing surface 42*a* which is an upper side of the polishing pad 42 held by the polishing table 43. The substrate W is placed in sliding contact with the polishing pad 42 and polished in the presence of the polishing liquid supplied from the polishing-liquid-supply nozzle 45 onto the polishing pad 42.

The substrate W has an upper layer (e.g., a metal or a silicon oxide film) and a lower layer (e.g., a silicon film). Since the upper layer and the lower layer of the substrate W are constituted by different materials, an acoustic spectrum (or a power spectrum) emitted from the substrate W pressed against the polishing pad 42 changes when the lower layer of the substrate W is exposed as a result of the progress of polishing of the upper layer. A structure of the substrate W in the present invention is not limited to this example, and various materials used in a semiconductor chip manufacturing process can be used.

FIG. 3 is a side view schematically showing the structure of the polishing unit. The top-ring shaft 47 is coupled to a polishing-head motor 49 via a coupling device 48, such as a belt, and is configured to be rotatable. The top ring 41 rotates in the direction indicated by an arrow by the rotation of the top-ring shaft 47. The coupling device 48 and the polishing-head motor 49 are disposed inside the top-ring head cover 46 shown in FIG. 2.

Each of the acoustic sensors 50 and 51 is a general acoustic emission sensor (AE sensor). The two acoustic sensors 50 and 51 are arranged in a radial direction of the polishing pad 42 and disposed below the polishing pad 42. When the substrate W being polished is pressed against the polishing pad 42 and the substrate W deforms, the substrate W emits strain energy as an elastic wave (AE wave). The acoustic sensors 50 and 51 detect the elastic wave transmitted via the polishing pad 42 and output electric signals (acoustic signals). Alternatively, the acoustic sensors 50 and 51 may be constituted by ultrasonic microphones, and may detect a polishing sound caused by a friction between the substrate W pressed by the top ring 41 and the polishing pad 42 to output electric signals (acoustic signals). The acoustic sensors 50 and 51 are coupled to a rotary connector 61 installed inside the table shaft 43*a* via a connector attached to a side surface of the table shaft 43*a*. The rotary connector 61 is coupled to the controlling device 15, and the acoustic signals corresponding to the polishing sound of the substrate W are transmitted to the controlling device 15. As a result, the acoustic signals from the acoustic sensors 50 and 51 can be output to the controlling device 15 without being affected by the rotation of the table shaft 43*a*.

Figure 4:
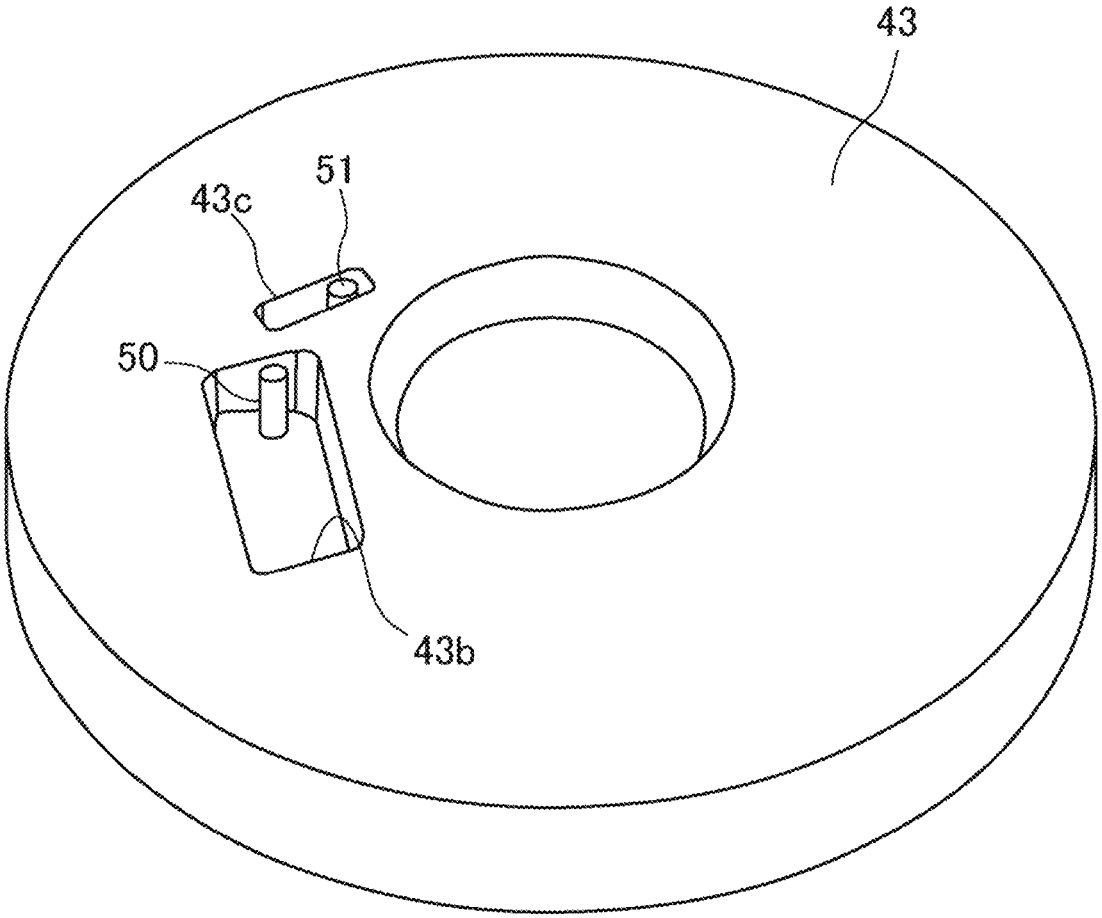
FIG. 4 is an explanatory diagram schematically showing a structure of a polishing table as viewed from a bottom thereof.

FIG. 4 is an explanatory diagram showing the polishing table 43 as viewed from bottom. Recesses 43*b* and 43*c* are formed in a bottom surface of the polishing table 43. The acoustic sensors 50 and 51 are disposed inside the recesses 43*b* and 43*c*, respectively, and fixed to the polishing table 43. By fixing the acoustic sensors 50 and 51 inside the polishing table 43 (close to the polishing surface), a detection accuracy of the acoustic sensors 50 and 51 can be improved.

Figure 5:
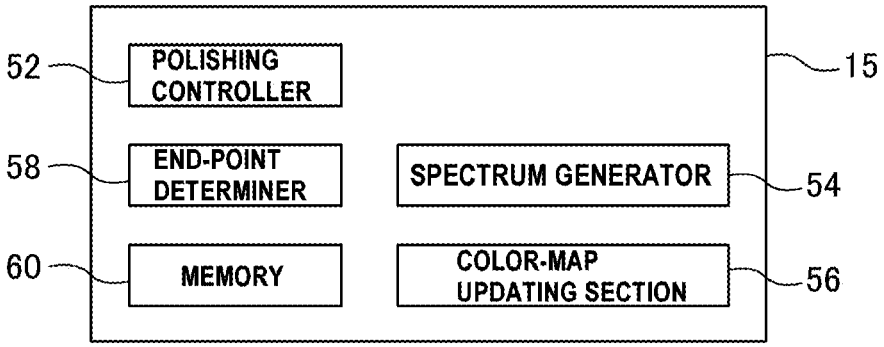
FIG. 5 is an explanatory diagram showing an example of a structure of a controlling device.

FIG. 5 shows an example of a structure of the controlling device 15. The controlling device 15 is, for example, a general-purpose computer device, and includes a CPU, a memory storing a control program, an input device, a display, etc. The controlling device 15 runs the control program stored in the memory to thereby operate as a polishing controller 52, a spectrum generator 54, a color-map updating device 56, and an end-point determiner 58, thereby managing and controlling operations of the polishing unit 40. The structure of the controlling device 15 is not limited to the structure shown in FIG. 5, and also includes a structure for controlling operations of other elements of the substrate processing apparatus 10 (e.g., the loading-unloading section 12 and the cleaning section 14).

The control program for controlling the operations of the substrate processing apparatus 10 may be installed in advance in a computer constituting the controlling device 15, or may be stored in a storage medium, such as a CD-ROM, a DVD-ROM, etc., or may be installed in the controlling device 15 via the Internet.

The polishing controller 52 controls the operations of the top ring 41, the polishing table 43, etc., which constitute the polishing unit 40, and instructs the polishing unit 40 to perform a polishing process on the substrate W held by the top ring 41.

The spectrum generator 54 performs FFT (Fast Fourier Transform) on the data of the acoustic signals (the signals generated due to the strain or distortion of the substrate W pressed against the polishing pad 42) transmitted from the acoustic sensors 50 and 51. The spectrum generator 54 extracts a frequency component and its intensity and outputs a power spectrum (sound-pressure level to frequency) of the acoustic signals of the substrate W. As for the number of data of acoustic signals used for generating the power spectrum, all the data obtained from the start of substrate polishing may be used, but it is desirable to use only the data of acoustic signals in a latest regular time (e.g., 10 seconds), thereby reducing a time for the generating process of the power spectrum.

Figure 6:
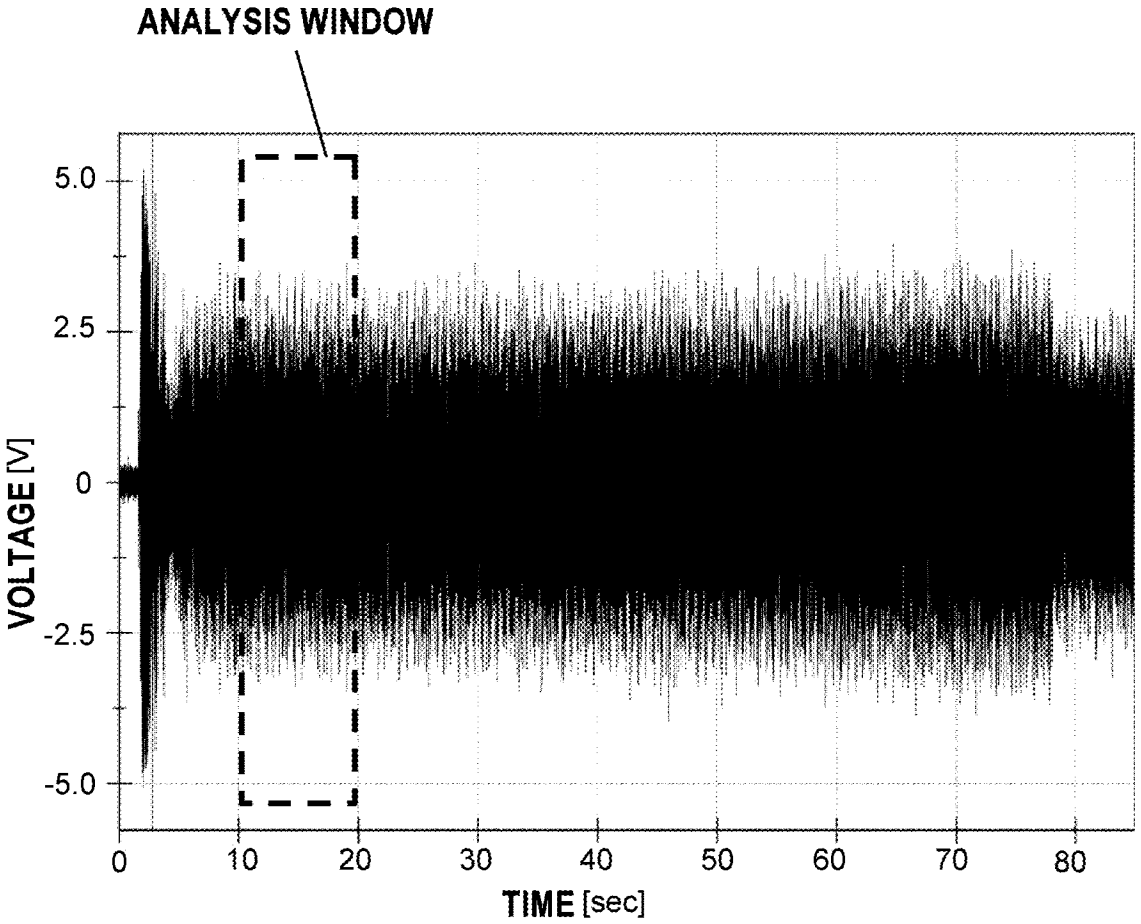
FIG. 6 is a graph showing an example of signals from an acoustic sensor.

FIG. 6 is a graph showing an example of signals transmitted from the acoustic sensors 50 and 51. Horizontal axis represents elapsed time from the start of substrate polishing, and vertical axis represents intensity (or voltage) of the acoustic signals. Along with the polishing of the substrate W, the signals (acoustic signals) are generated due to the strain or distortion of the substrate W pressed by the top ring 41. The spectrum generator 54 generates the power spectrum using the latest signals, e.g., signals within 10 seconds (signals in a section included in an "analysis window" shown by a dotted line in FIG. 6). In the present embodiment, the power spectrum may be generated by using signals from only one of these two acoustic sensors 50 and 51, or an average value of signals from these two acoustic sensors 50 and 51 may be used. In one embodiment, a power spectrum based on the acoustic signal from the acoustic sensor 50 and a power spectrum based on the acoustic signal from the other acoustic sensor 51 may be separately generated and may be separately used for a determination of end-point detection described below.

Figure 7:
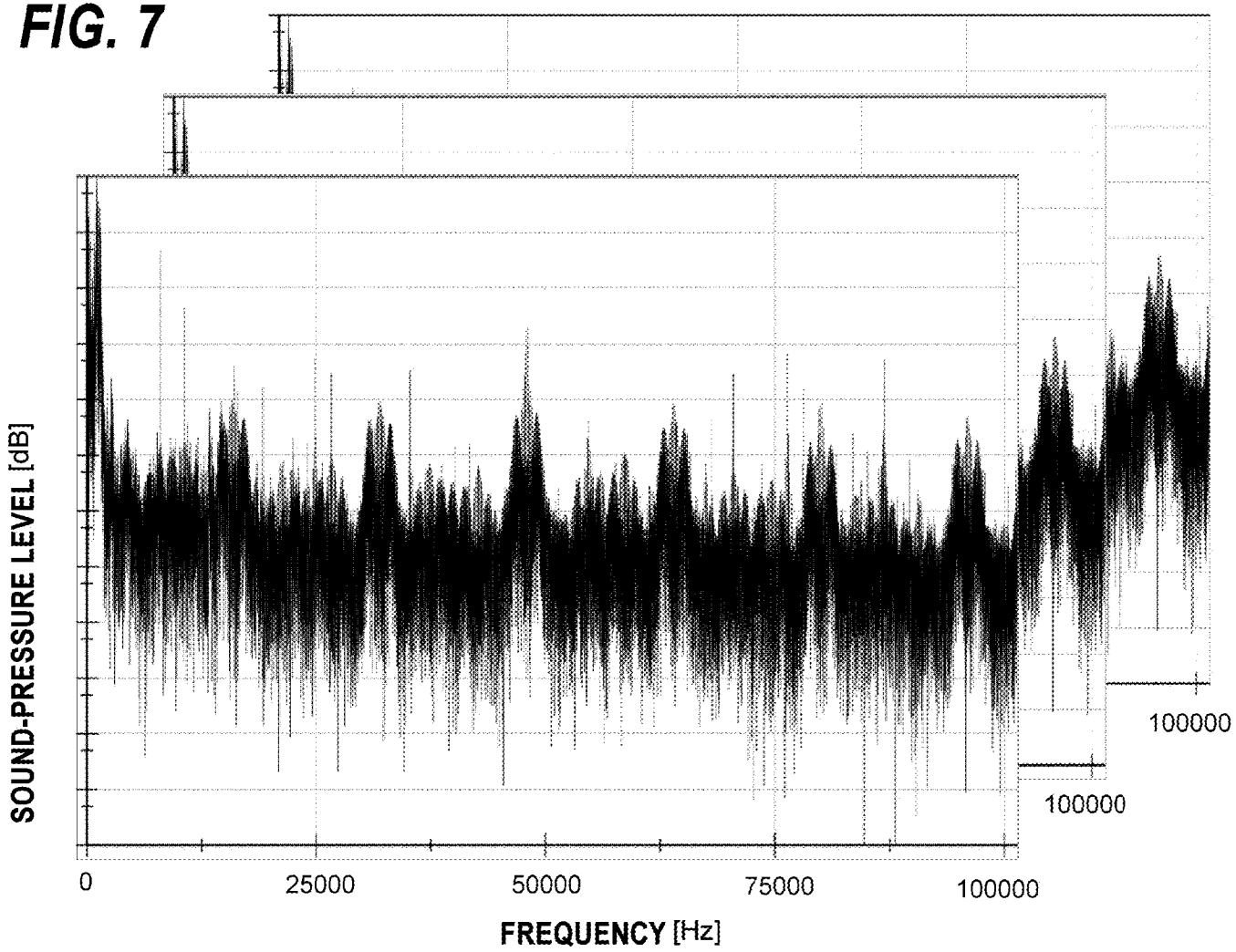
FIG. 7 is a graph showing an example of power spectra of sound-pressure level.

FIG. 7 is a graph showing an example of the power spectra generated as described above (the acoustic signals of only one of the two acoustic sensors 50 and 51 are used in this graph). Horizontal axis represents the frequency and vertical axis represents the sound-pressure level. As described above, the spectrum generator 54 uses the acoustic signals contained in the analysis window (see FIG. 6) to generate the power spectrum at regular time intervals (e.g., 1 second intervals). As a result, along with the polishing of the substrate W, data of a plurality of power spectra are generated in time series (FIG. 7 schematically shows the generation of three stacked graphs for each analysis window).

Since the sound-pressure level in a low-frequency region is often irrelevant to a change in the substrate polishing situation, a high-pass filter (or a band-pass filter) may be provided at the output side of the acoustic sensors 50 and 51 to cut off the signals in the low-frequency region.

Figure 8:
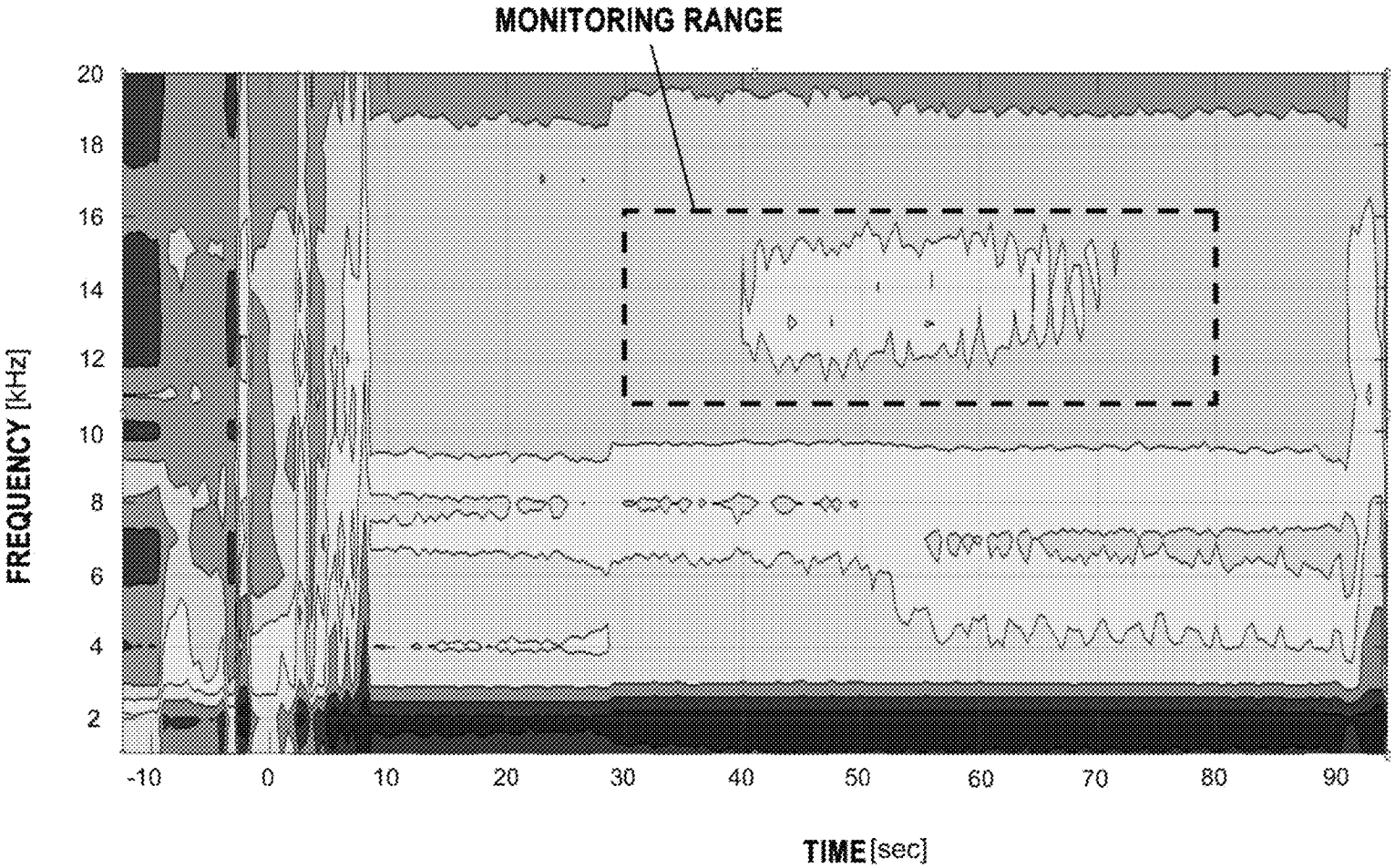
FIG. 8 is a graph showing an example of a color map of the sound-pressure level.

The color-map updating device 56 generates a graph (color map) indicating changes in the frequency and the sound-pressure level with time by arranging the data of power spectra generated by the spectrum generator 54 in time-series order. FIG. 8 is a graph showing an example of the color map. Horizontal axis represents the time and vertical axis represents the frequency. The sound-pressure level at each point in time and each frequency is color-coded (or constituted by a distribution of black and white density). The generated color map is displayed on the display (display device) provided in the controlling device 15.

In the example of FIG. 8, the color map is configured such that the sound-pressure level is displayed in different colors each for a predetermined value (e.g., each 20 dB), but the color map is not limited to this embodiment. For example, the color map may be configured such that the colors change in a gradation manner.

In the graph of FIG. 8, "0" on the horizontal axis (time) represents a polishing start time (i.e., a time when measuring of the sound-pressure signals by the acoustic sensors 50 and 51 is started). Since the spectrum generator 54 generates a power spectrum using the latest signals, e.g., signals within 10 seconds (this time corresponding to a width of the "analysis window" in FIG. 6), the power spectrum in the first about 10 seconds (in which no signal is generated) is not used for the determination of polishing end described below. Alternatively, the spectrum generator 54 may be configured not to generate the power spectrum. The example of FIG. 8 shows that the sound-pressure level is relatively high in the low-frequency region, and the higher the frequency, the lower the sound-pressure level.

The end-point determiner 58 monitors the sound-pressure level in a predetermined frequency band (monitoring range) of the color map, and determines whether or not the color map in the monitoring range has changed. In the example of FIG. 8, the sound-pressure level in a range of 12 to 16 kHz is high when 40 seconds have passed from the start of polishing. This is because a lower layer, which was hidden under an upper layer at the start of polishing, is gradually exposed, and the spectrum of the acoustic signals from the substrate W is changed due to the influence of the lower layer.

When the end-point determiner 58 detects the change in the color map in the monitoring range, the end-point determiner 58 sends a signal instructing the end of substrate polishing to the polishing controller 52. For example, when a rate of change in the sound-pressure level in a certain time exceeds a predetermined value, when an area of a region where the sound-pressure level has increased in the color map exceeds a predetermined value, or when the sound-pressure level in the monitoring range increases and then decreases, causing an amount of variation to be less than a threshold value, the end-point determiner 58 can detect that the lower layer of the substrate W is exposed.

The monitoring range for monitoring the sound-pressure level by the end-point determiner 58 can be set according to a combination of materials of layers constituting the substrate W. Alternatively, prior to the actual polishing of the substrate W, test polishing may be performed using a dummy substrate having the same layer structure, so that a frequency band in which a generated color map has changed may be set to be the monitoring range.

A memory 60 is, for example, a non-volatile memory device. Information of the signals received from the acoustic sensors 50 and 51, information of the power spectrum generated by the spectrum generator 54, information of the color map generated by the color-map updating device 56, and information of the monitoring range determined for each type of each layer constituting the substrate W are stored in the memory 60 and appropriately read out from the memory 60.

Figure 9:
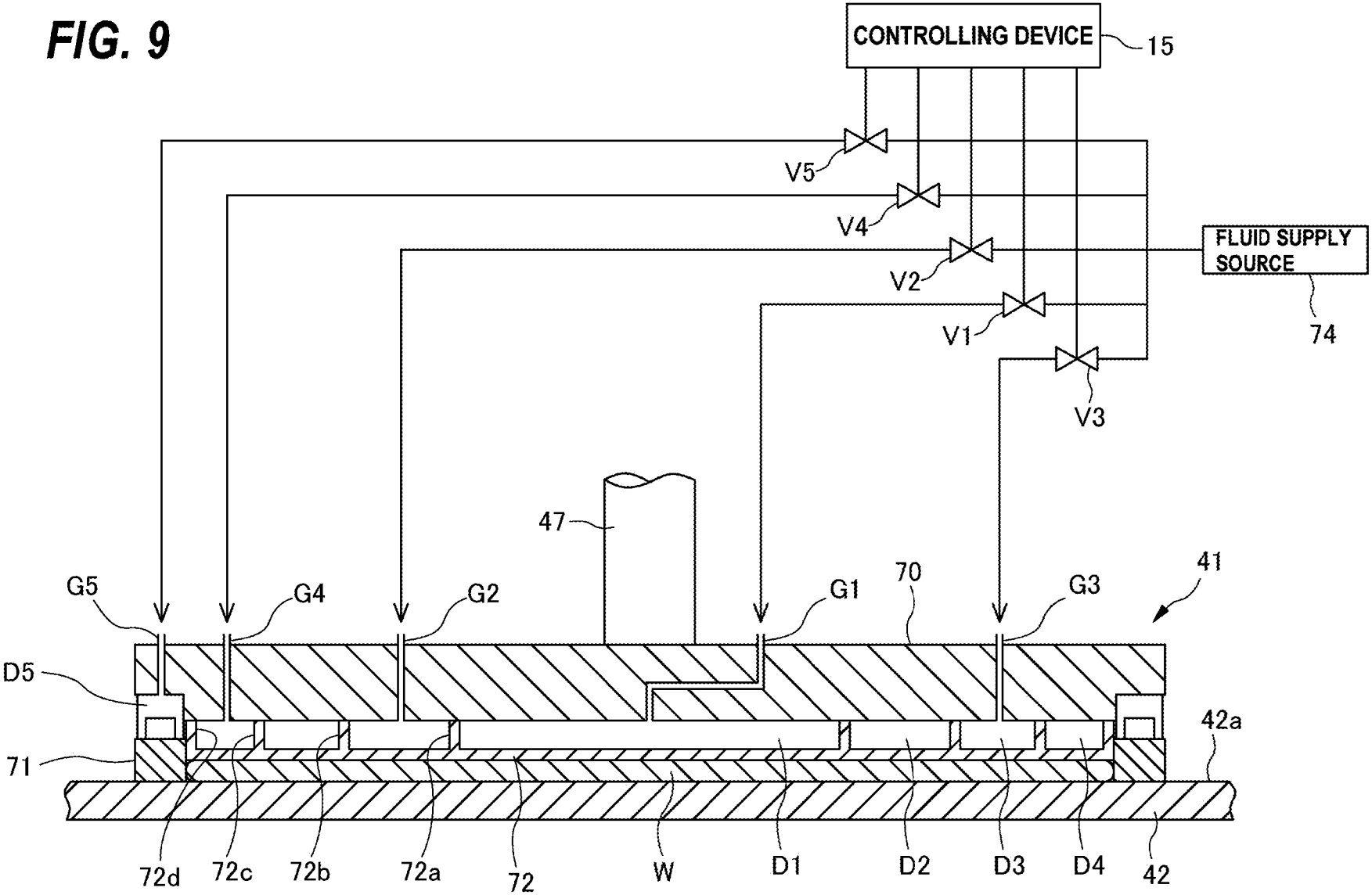
FIG. 9 is a partial cross-sectional view showing a structure of the substrate polishing unit.

As shown in FIG. 9, the top ring 41 includes a head body 70 fixed to a lower end of the top-ring shaft 47, a retainer ring 71 configured to support a side edge of the substrate W, and a flexible elastic membrane 72 configured to press the substrate W against the polishing surface of the polishing pad 42. The retainer ring 71 is disposed so as to surround the substrate W, and is coupled to the head body 70. The elastic membrane 72 is attached to the head body 70 so as to cover a lower surface of the head body 70.

The head body 70 is made of a resin, such as engineering plastic (e.g., PEEK), and the elastic membrane 72 is made of a rubber material having excellent strength and durability, such as ethylene propylene rubber (EPDM), polyurethane rubber, or silicon rubber.

The head body 70 and the retainer ring 71 constituting the top ring 41 are configured to rotate together by the rotation of the top-ring shaft 47.

The retainer ring 71 is disposed so as to surround the head body 70 and the elastic membrane 72. The retainer ring 71 is a member made of a ring-shaped resin material that is brought into contact with the polishing surface 42*a* of the polishing pad 42. The retainer ring 71 is disposed so as to surround the peripheral edge of the substrate W held by the head body 70, and supports the peripheral edge of the substrate W so that the substrate W being polished does not slip out the top ring 41.

The retainer ring 71 has an upper surface coupled to an annular retainer-ring pressing mechanism. The retainer-ring pressing mechanism is configured to apply a uniform downward load to the entire upper surface of the retainer ring 71. As a result, a lower surface of the retainer ring 71 is pressed against the polishing surface 42*a* of the polishing pad 42.

The elastic membrane 72 has a plurality of (four in FIG. 9) annular circumferential walls 72*a*, 72*b*, 72*c*, and 72*d* arranged concentrically. These circumferential walls 72*a* to 72*d* form a circular first pressure chamber D1 located at the center, and annular second, third, and fourth pressure chambers D2, D3 and D4. These pressure chambers D1, D2, D3 and D4 are located between an upper surface of the elastic membrane 72 and the lower surface of the head body 70.

A flow passage G1 communicating with the central first pressure chamber D1 and flow passages G2 to G4 communicating with the second to fourth pressure chambers D2 to D4 are formed in the head body 70. These flow passages G1 to G4 are coupled to a fluid supply source 74 via fluid lines, respectively. On-off valves V1 to V4 and pressure controllers (not shown) are attached to the fluid lines.

A retainer pressure chamber D5 is formed just above the retainer ring 71. The retainer pressure chamber D5 is coupled to the fluid supply source 74 via a flow passage G5 formed in the head body 70 and a fluid line to which an on-off valve V5 and a pressure controller (not shown) are attached. The pressure controllers attached to the fluid lines have a pressure regulating function to regulate pressures of the pressure fluid supplied from the fluid supply source 74 to the pressure chambers D1 to D4 and the retainer pressure chamber D5, respectively. Operations of the pressure controllers and the on-off valves V1 to V5 are controlled by the controlling device 15.

Figure 10:
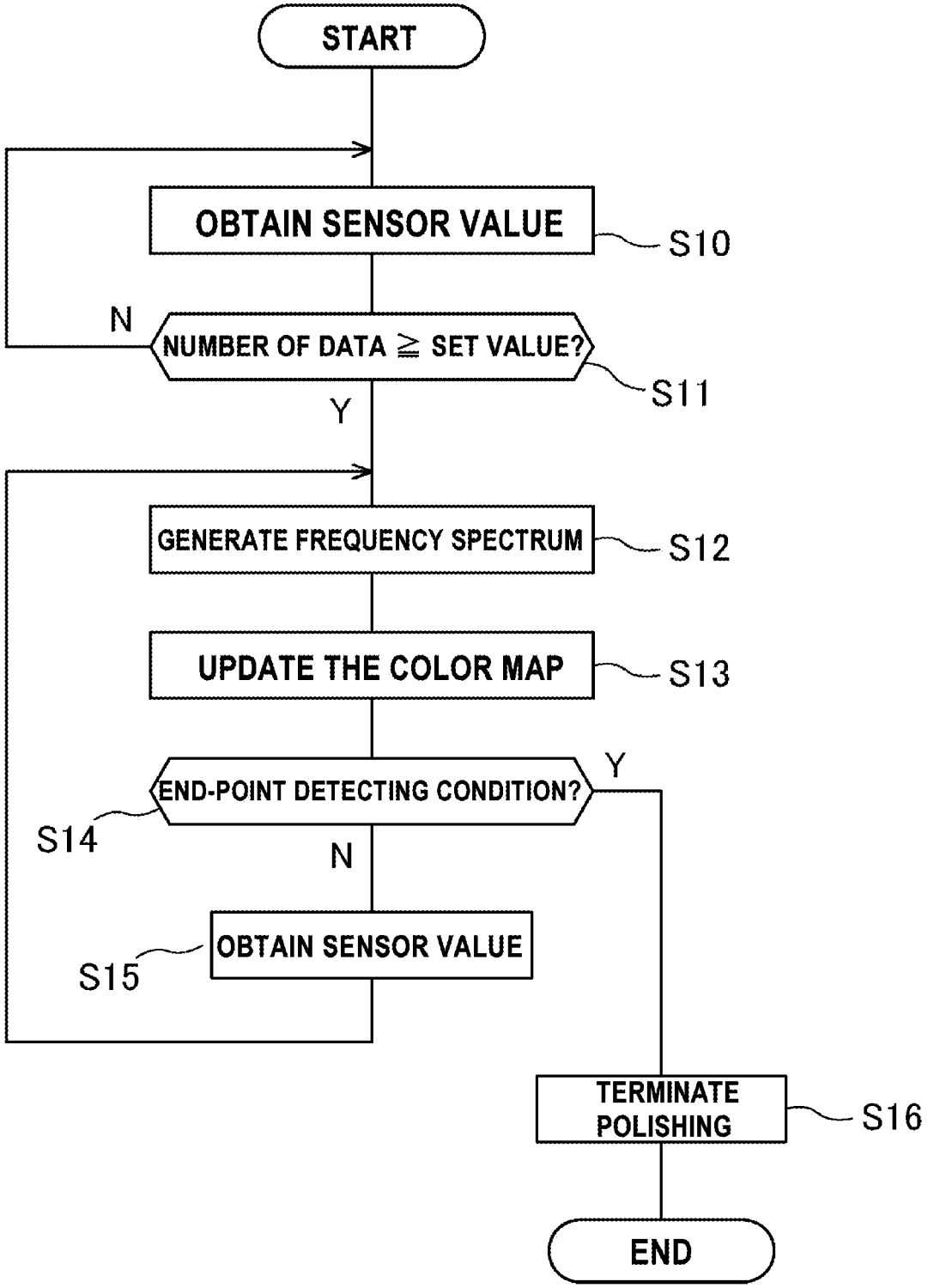
FIG. 10 is a flowchart showing an example of processing of a substrate.

Hereinafter, the operations of the substrate polishing apparatus 10 having the above structure will be described with reference to a flowchart of FIG. 10. After polishing of the substrate W is started, the acoustic sensors 50 and 51 detect the polishing sound of the substrate W transmitted via the polishing pad 42, convert the polishing sound into acoustic signals indicating the sound-pressure levels, and output the acoustic signals to the controlling device 15 (step S10).

The controlling device 15 stores the data of the acoustic signals received from the acoustic sensors 50 and 51 in the memory 60. Then, the controlling device 15 determines whether or not an amount of data of the acoustic signals stored in the memory 60 exceeds a predetermined value (which may be, for example, an amount of data within 10 seconds) (step S11). When the amount of data exceeds the predetermined value, the spectrum generator 54 reads out the data of the latest acoustic signals obtained in 10 seconds stored in the memory 60, and performs FFT processing to generate a frequency spectrum (or a power spectrum) at a certain point in time (step S12). Data of frequency spectra is stored in the memory 60.

Next, the color-map updating device 56 of the controlling device 15 generates, for example, a color map as shown in FIG. 8 by arranging the data of frequency spectra stored in the memory 60 in a time-series order, and updates the color map (step S13). The data of color map is stored in the memory 60.

The end-point determiner 58 determines whether or not the color map generated (updated) by the color-map updating device 56 satisfies a predetermined end-point detecting condition (e.g., whether or not a predetermined change in the sound-pressure level has occurred in the monitoring region (monitoring frequency region)) (step S14). When the end-point detecting condition is not satisfied, the controlling device 15 receives the data of acoustic signals from the acoustic sensors 50 and 51 (step S15). Then, returning back to step S12, the spectrum generator 54 generates a power spectrum, and the color-map updating device 56 updates the color map.

When the end-point determiner 58 determines that the end-point detecting condition is satisfied, the polishing controller 52 stops the rotations of the top ring 41 and the polishing pad 42, and terminates the polishing process (step S16).

As described above, the color map (intensity distribution map) of the sound-pressure level is generated based on the acoustic signals obtained by the acoustic sensors, and the end point of the substrate polishing is detected from the change in the color map. Therefore, the end point of the substrate polishing can be accurately detected.

In the above embodiment, the power spectrum is generated by using the acoustic signals from the two acoustic sensors 50 and 51, while the number of acoustic sensors is not limited to two, and one acoustic sensor or three or more acoustic sensors may be provided.

Figure 11:
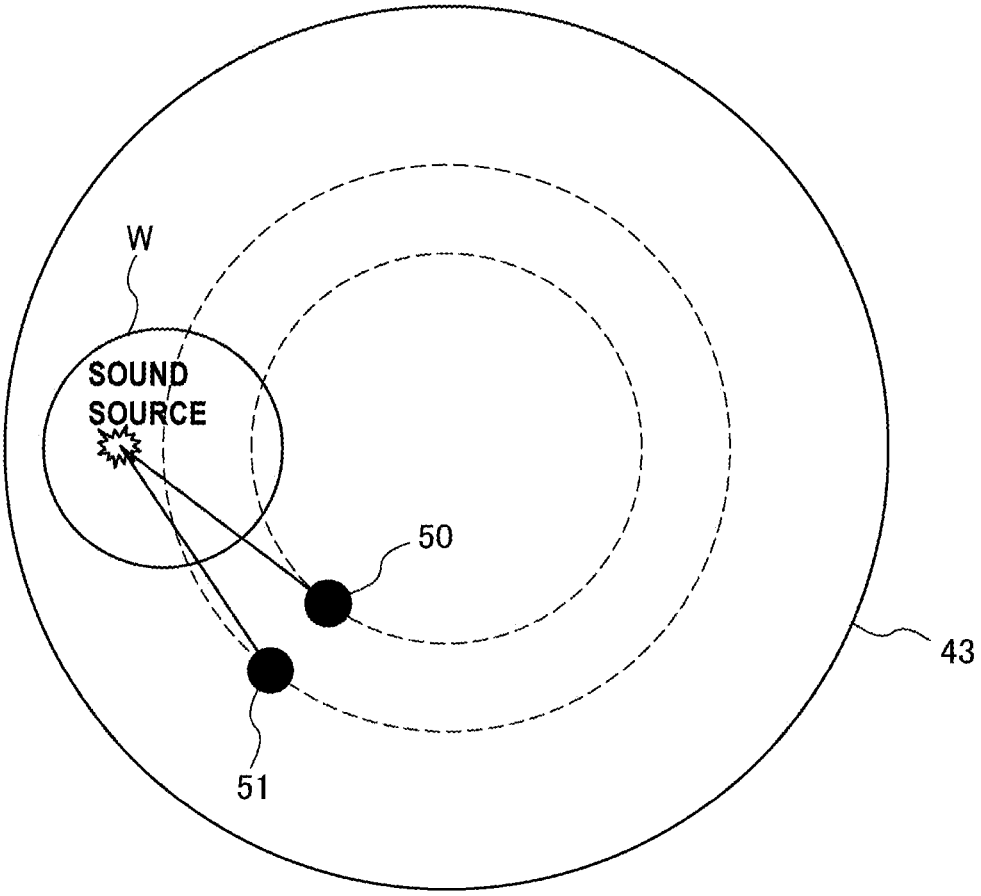
FIG. 11 is an explanatory diagram showing a positional relationship between a sound source in a substrate and acoustic sensors.

Power spectra and color maps may be individually generated by using the acoustic signals acquired from the two acoustic sensors 50 and 51, respectively, and when one or both of the color maps satisfy the end-point detecting condition, the substrate polishing may be terminated. In this case, an area where the surface of the substrate W is exposed (sound source in FIG. 11) may be identified or determined from a difference in time when the change in the two color maps has occurred. By reducing the pressure in the pressure chamber corresponding to the exposed area, a polishing speed of the exposed area can be regulated. As a result, the variation in the film thickness distribution over the surface of the substrate during polishing can be suppressed.

Figure 12:
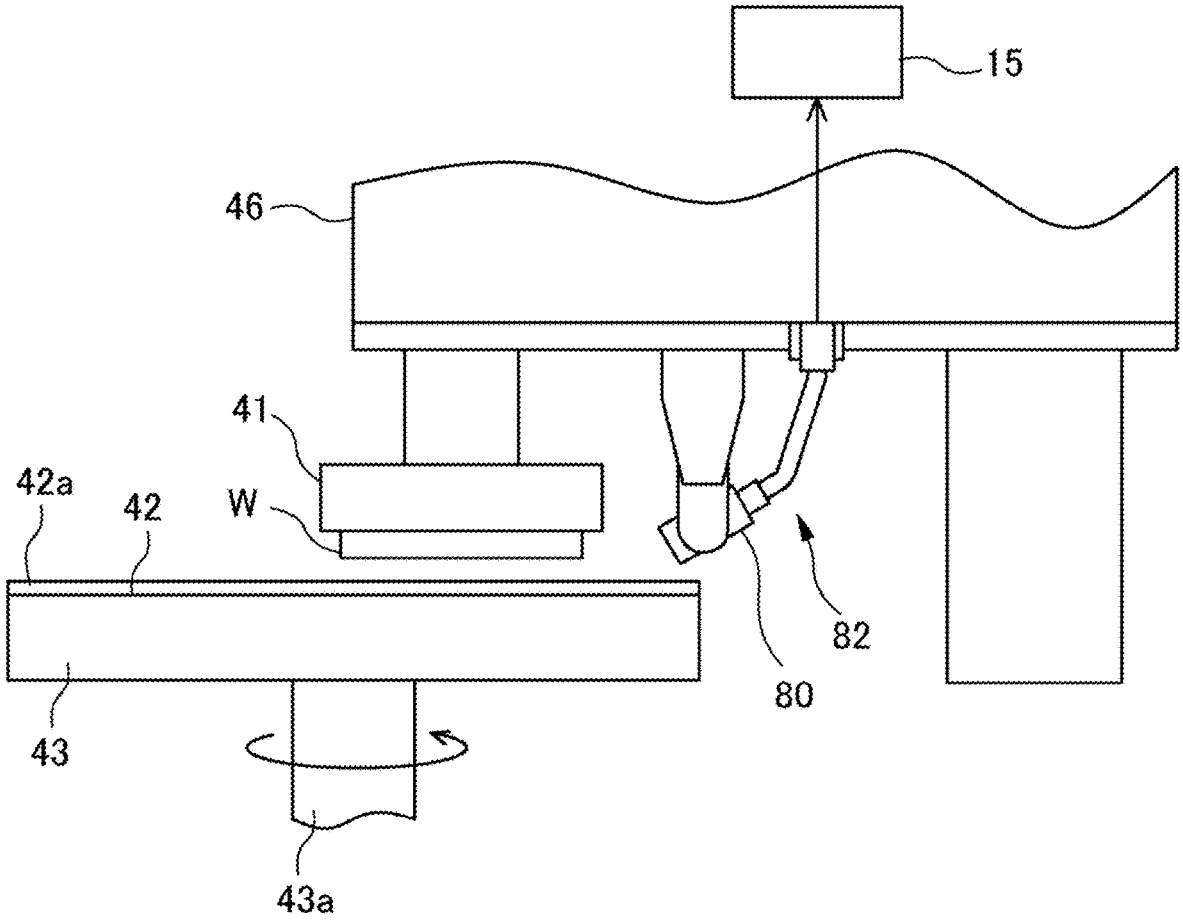
FIG. 12 is a side view showing another a structure of the substrate polishing unit.

In the above embodiment, the acoustic signal of the substrate W is generated by using the acoustic sensor embedded in the polishing table, but the present invention is not limited to this embodiment. For example, as shown in FIG. 12, a sound-collecting microphone (or an ultrasonic microphone) 80 as a polishing-sound sensor may be disposed above the polishing table, so that acoustic signal from the substrate W may be generated by using the sound-collecting microphone 80 and a color map may be generated in the same manner as the above embodiment. In the example shown in FIG. 12, the sound-collecting microphone 80 is fixed to a bottom of the top-ring head cover 46 by a holding mechanism 82.

Figure 13:
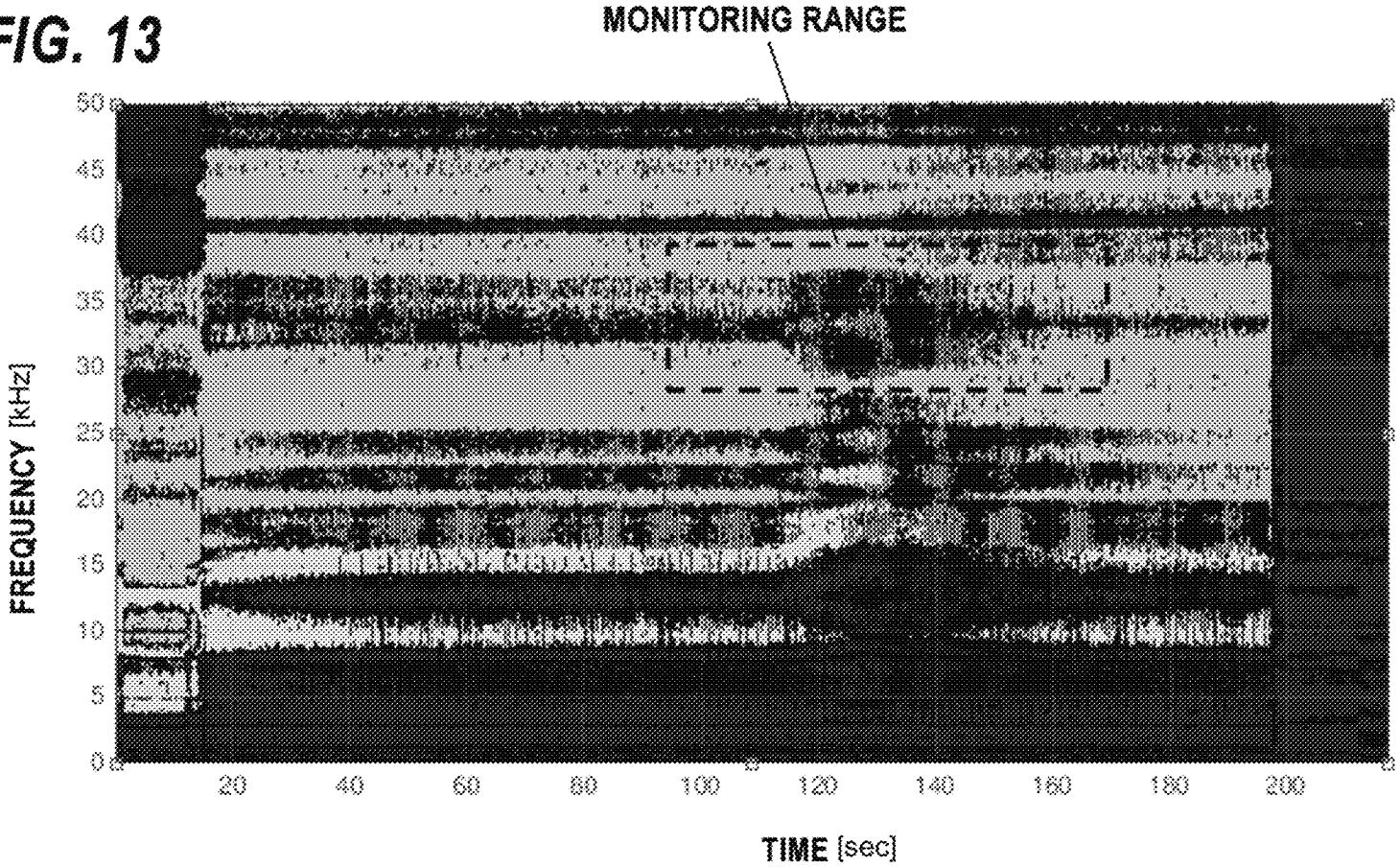
FIG. 13 is a graph showing another example of the color map of the sound-pressure level.

FIG. 13 is an example of a color map generated by acoustic signals obtained by the sound-collecting microphone 80. As with the case of using the acoustic sensors embedded in the polishing table, an exposure of the lower layer (i.e., the end of the substrate polishing) can be detected by detecting a change in sound-pressure level in a predetermined frequency range (monitoring range). In the example of FIG. 13, the color map is configured so that the sound-pressure level is displayed in different colors each for a predetermined value, but the color map is not limited to this embodiment. For example, the color map may be configured such that the colors change in a gradation manner.

In the above embodiments, the end point of the substrate polishing is detected from the change in the color map, but the detecting method for the end point of the substrate polishing is not limited to these embodiments. For example, a trained model may be generated by machine learning using a plurality of color-map images each indicating that an end point is reached, and the end point may be detected by image detection using the trained model.

Figure 14:
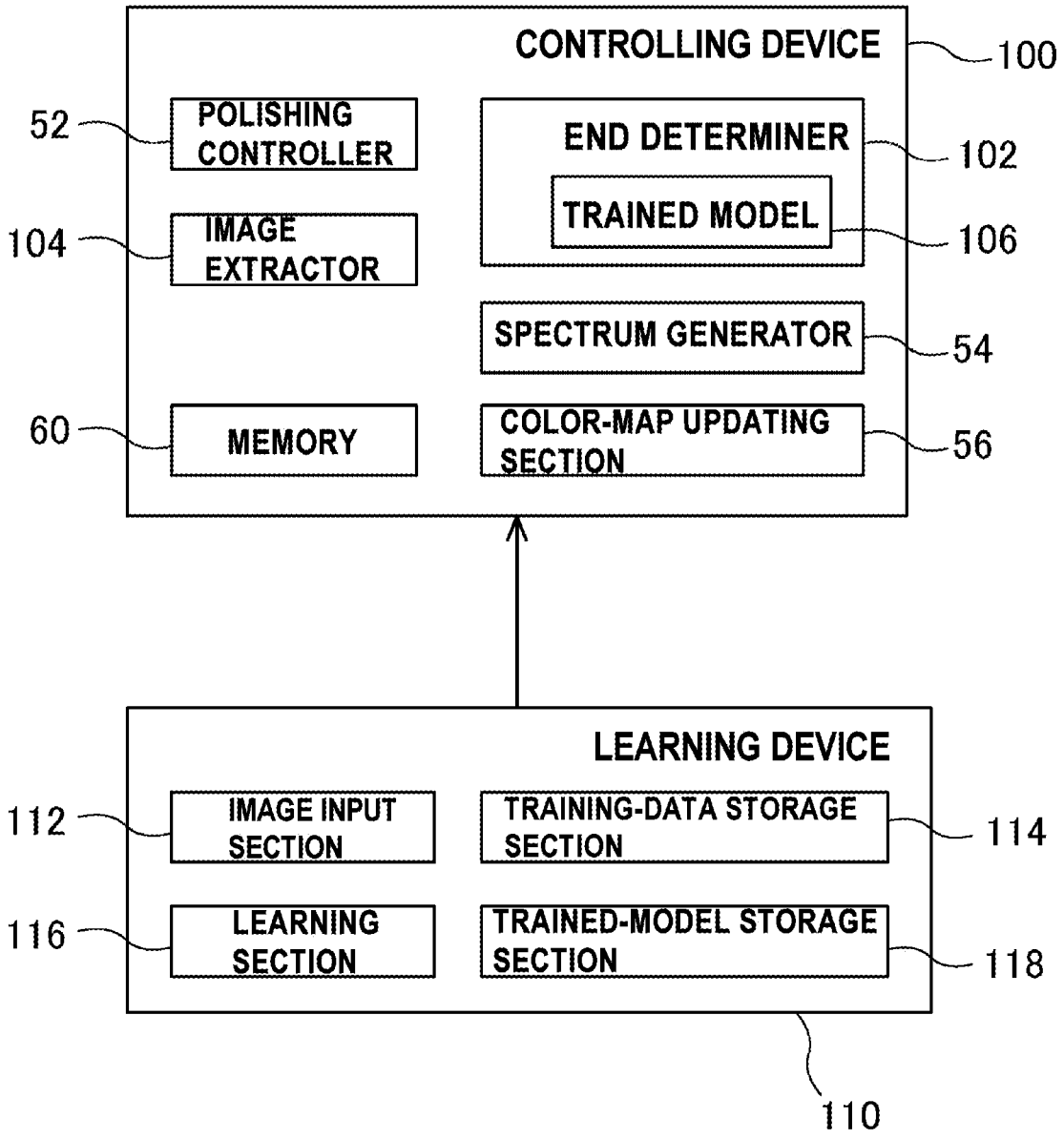
FIG. 14 is an explanatory diagram showing an example of a structure of a controlling device and a learning device.

FIG. 14 shows a structure of a system in an embodiment of performing the image detection using the trained model. The same structures as the above embodiments are given the same reference numerals and the detailed descriptions are omitted. In FIG. 14, the system includes a controlling device 100 configured to perform a substrate polishing control and an end-point detection, and a learning device 110 configured to perform machine learning for the color-map image. The controlling device 100 includes an end determiner 102 and an image extractor 104, in addition to the structure of the controlling device 15 described above.

The end determiner 102 includes a trained model 106, which will be described below. The trained model 106 is a trained machine-learning model that has been trained to estimate a degree to which an image of the generated color map matches an image of a polishing end using, for example, a neural network. The trained model 106 is transmitted from the learning device 110 and stored in the memory 60 of the controlling device 100, and is read out by the end determiner 102 when the controlling device 100 determines the polishing end based on the image detection.

Figure 15:
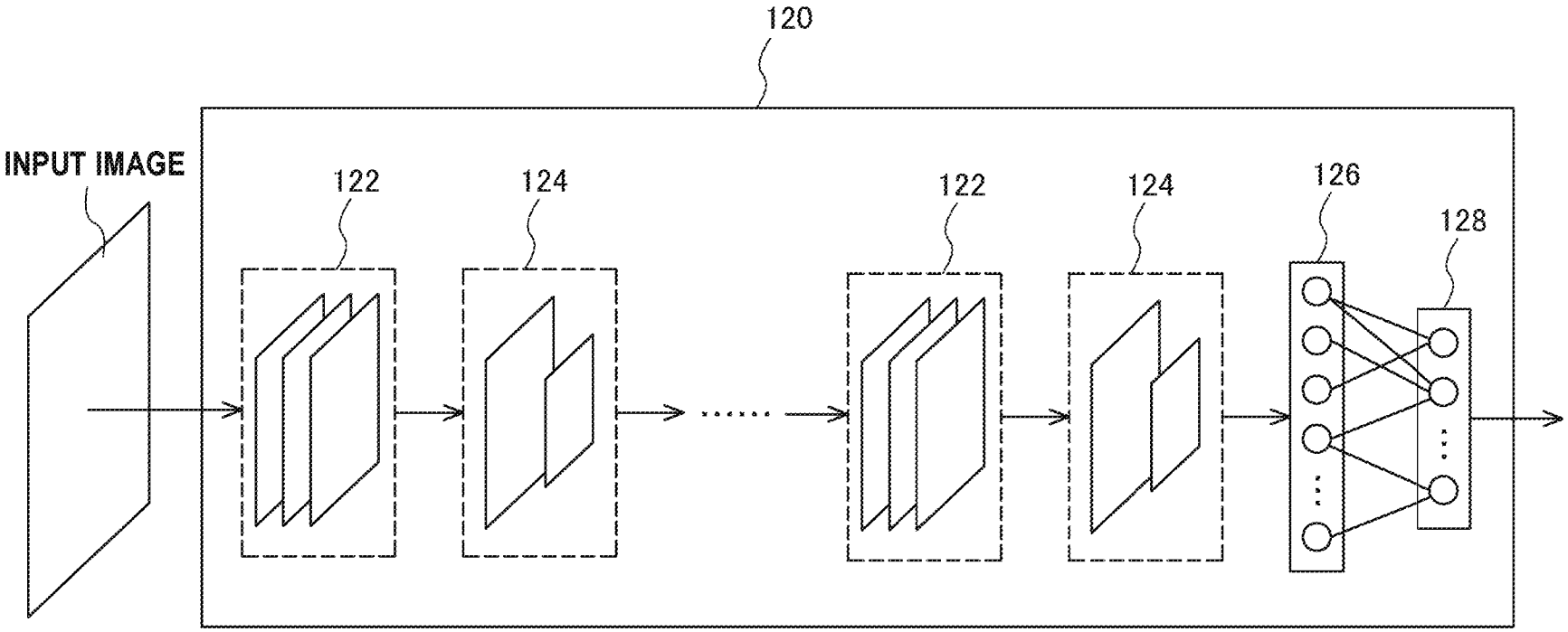
FIG. 15 is an explanatory diagram showing an example of a neural network for image detection.

The neural network used in this embodiment may be, for example, a convolutional neural network 120 shown in FIG. 15. The convolutional neural network 120 has a structure in which convolutional layers 122 and pooling layers 124 are alternately coupled. An output of an output-side pooling layer 124 is input to a fully-connected layer 126, and an output of the fully-connected layer 126 is input to an output layer 128.

In the convolution layer 122, features in each local region of the input image are output by calculating a correlation between the image data of the input image and predetermined weight filter. The pooling layer 124 outputs a maximum value or an average value of the features in the local region output from the convolution layer 122. The fully-connected layer 126 is constituted by a plurality of layers, each layer has one or more neurons (nodes), and the neurons in adjacent layers are coupled to each other. The output layer 128 is disposed at the outermost side of the neural network 120, and outputs estimated information indicating the degree to which the input color-map image matches the image of the polishing end.

Weights are set for connections of the neurons, and a threshold is set for each neuron. The output of each neuron is determined based on whether the sum of the product of the input to each neuron and the weight exceeds the threshold, so that estimated information is output from the neural network. When the value of the estimated information output from the trained model exceeds a preset reference value, the end determiner determines that the input image matches the image of the polishing end, and terminates the substrate polishing.

The neural network is not limited to this embodiment. For example, a fully-connected neural network including an input layer, intermediate layers, and an output layer may be used, or a combination of a convolutional neural network and a fully-connected neural network may be used. A recurrent neural network having a loop inside (e.g., an LSTM network) may be provided.

The image extractor 104 extracts an image of a part of the color map defined by a predetermined frequency band and predetermined time. This color map is updated by the color-map updating device 56. The image extractor 104 inputs the extracted image to the trained model of the end determiner 102. As a result, image data of a portion unnecessary for the end-point detection is omitted, and a processing time for the end-point detection based on the image detection can be shortened. A resolution of the extracted image in the image extractor 104 may be lowered, so that the processing time for the end-point detection can be shortened.

The learning device 110 is, for example, a general-purpose computer, and includes a CPU, a memory storing a learning program, an input device, a display device, etc. The learning device 110 is coupled to the controlling device 100 via a communication line (not shown). The learning device 110 runs the learning program stored in advance in the memory (not shown) (or installed through a network) to thereby operate as an image input section 112, a training-data storage section 114, a learning section 116, and a trained-model storage section 118. The learning device 110 and the controlling device 100 may be integrally configured.

The image input section 112 inputs therein a color-map image at a point in time at which substrate polishing is terminated in test polishing, and stores, in the training-data storage section 114, a part of the image defined by a predetermined frequency band and predetermined time as training data. The learning section 116 has the same structure as the neural network 120 described above. The learning section 116 trains the neural network so as to adjust the weight and the threshold of each neuron so that when the training data is input, estimated information exceeding the reference value is output. When the estimated information exceeding the reference value is output for the plurality of training data stored in the training-data storage section 114, the learning is terminated and the trained model is stored in the trained-model storage section 118. Further, the learning device 110 transmits the data of the trained model, which has been trained, to the controlling device 100, whereby the trained model 106 in the controlling device 100 is updated.

Figure 16:
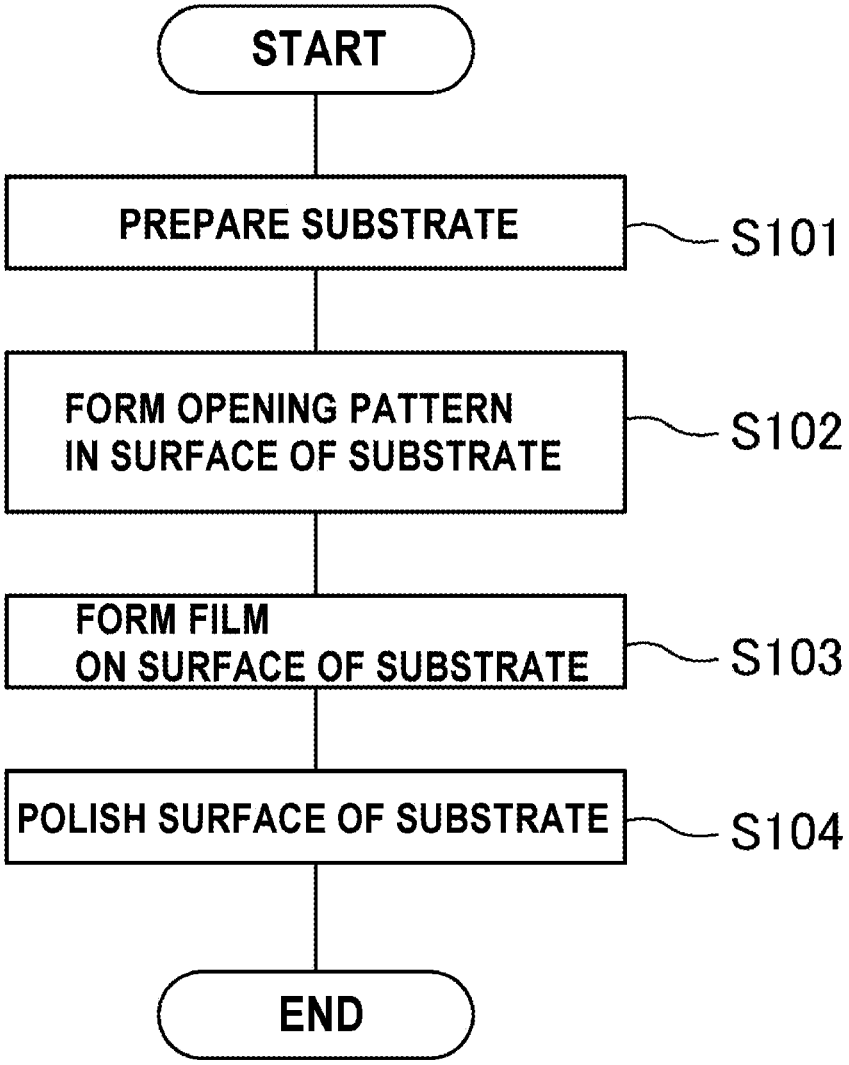
FIG. 16 is a flowchart schematically showing a manufacturing method for a semiconductor device.

FIG. 16 is a flowchart schematically showing a manufacturing method for a semiconductor device including the control method for processing of a substrate according to the present embodiment. First, a substrate W is prepared (step S101). Next, an opening pattern is formed in a surface of the substrate W using, for example, photolithography (step S102). A metal film, a silicon oxide film, or a film of other material is formed on the surface of the substrate W having the opening pattern using, for example, chemical vapor deposition (CVD) or physical vapor deposition (PVD) (step S103). Then, the surface of the substrate W is polished according to the control method of processing of the substrate of the present embodiment (step S104). Formation of an opening pattern in the surface of the substrate W, film formation on the surface of the substrate W, and polishing of the substrate W may be performed a plurality of times.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. The present invention is not intended to be limited to the embodiments described herein but is to be accorded the widest scope as defined by limitation of the claims.

What is claimed is:

1. A control method for processing of a substrate by a substrate processing apparatus configured to polish the substrate by pressing the substrate against a polishing pad, comprising:

performing, on a dummy substrate having a same layer structure as the substrate, a first polishing to determine a monitoring frequency band;

after the first polishing, performing a second polishing on the substrate;

detecting an acoustic event occurring during the second polishing and outputting the acoustic event as acoustic signals;

during the second polishing, generating power spectra from the acoustic signals, each of the power spectra indicating a spectrum of a sound-pressure level;

during the second polishing, generating a power spectrum map indicating a temporal change in power spectrum by arranging the power spectra in a time-series order, wherein the power spectrum map, having a horizontal axis representing a time and a vertical axis representing a frequency, is configured to represent the sound-pressure level color-coded or constituted by a distribution of black and white density; and during the second polishing, detecting a polishing end point of the substrate upon detecting at least one of the following conditions:

a first condition in which a rate of a change in the sound-pressure level only in the monitoring frequency band in the power spectrum map within a predetermined time exceeds a first threshold;

a second condition in which an area corresponding to the change in the sound-pressure level only in the monitoring frequency band on the power spectrum map exceeds a second threshold; or a third condition in which, when the sound-pressure level only in the monitoring frequency band in the power spectrum map increases and subsequently decreases, the rate of the change in the monitoring frequency band in the power spectrum map falls below a third threshold.

2. The control method according to claim 1, wherein the power spectrum corresponding to a part of the power spectra is generated using only a part of the acoustic signals detected within an analysis window up to a time of generating the power spectrum.

3. The control method according to claim 1, wherein the substrate processing apparatus includes a polishing head forming pressure chambers configured to press the substrate, and a pressure controller configured to perform pressure feedback control to individually control pressures in the pressure chambers, wherein detecting the polishing end point of the substrate further comprises:

detecting times when changes in power spectrum maps occur, the power spectrum maps being generated by acoustic sensors provided in the polishing pad; and determining a physical area where a surface of the substrate is exposed based on a difference between the times, and wherein the pressure controller reduces pressure in pressure chamber corresponding to the physical area where the surface of the substrate is exposed.

4. The control method according to claim 1, wherein an acoustic sensor configured to detect the acoustic event is disposed in a recess formed in a polishing table supporting the polishing pad.

5. The control method according to claim 2, wherein the power spectrum corresponding to the part of the power spectra is generated by storing, using a memory, the acoustic signals for a time period corresponding to the analysis window;

performing an FFT processing to generate the power spectrum; and storing, using the memory, the generated power spectrum, and wherein the power spectrum map is updated using data of the power spectrum stored in the memory.

6. A manufacturing method for a semiconductor device, comprising:

preparing a substrate;

forming an opening pattern in a surface of the substrate;

forming a film on the surface of the substrate;

polishing a dummy substrate that has a same layer structure as the substrate to determine a monitoring frequency band; and polishing the surface of the substrate by pressing the surface of the substrate against a polishing pad, polishing the surface of the substrate including:

detecting an acoustic event occurring while polishing the substrate and outputting the acoustic event as acoustic signals;

generating power spectra from the acoustic signals, each of the power spectra indicating a spectrum of a sound-pressure level;

generating a power spectrum map indicating a temporal change in power spectrum by arranging the power spectra in a time-series order, wherein the power spectrum map, having a horizontal axis representing a time and a vertical axis representing a frequency, is configured to represent the sound-pressure level color-coded or constituted by a distribution of black and white density; and detecting a polishing end point of the substrate upon detecting at least one of the following conditions:

a first condition in which a rate of a change in the sound-pressure level only in the monitoring frequency band in the power spectrum map within a predetermined time exceeds a first threshold;

a second condition in which an area corresponding to the change in the sound-pressure level only in the monitoring frequency band on the power spectrum map exceeds a second threshold; or a third condition in which, when the sound-pressure level only in the monitoring frequency band in the power spectrum map increases and subsequently decreases, the rate of the change in the monitoring frequency band in the power spectrum map falls below a third threshold.

7. The manufacturing method according to claim 6, further comprising setting the monitoring frequency band according to a material constituting the layer structure of the substrate.

8. The manufacturing method according to claim 6, wherein the step of generating the power spectra comprises generating the power spectra using only the acoustic signals in a latest predetermined time.

9. The control method according to claim 5, wherein the polishing end point of the substrate is detected at least after elapse of the time period corresponding to the analysis window from a start of the second polishing.

10. The control method according to claim 9, wherein the analysis window is 10 seconds.

* * * * *